US007229142B2

(12) United States Patent
Lin

(10) Patent No.: US 7,229,142 B2
(45) Date of Patent: Jun. 12, 2007

(54) STRUCTURE OF PULL ADJUSTABLE CATCH FOR DRAWER SLIDE

(75) Inventor: Chun-Wei Lin, Taipei County (TW)

(73) Assignee: Nan Juen International Co., Ltd., Taipei County (TW)

( * ) Notice: Subject to any disclaimer, the term of this patent is extended or adjusted under 35 U.S.C. 154(b) by 0 days.

(21) Appl. No.: 10/986,090

(22) Filed: Nov. 12, 2004

(65) Prior Publication Data

US 2006/0082267 A1 Apr. 20, 2006

(51) Int. Cl.
*A47B 88/00* (2006.01)

(52) U.S. Cl. ..... 312/333; 312/334.44

(58) Field of Classification Search ..... 312/333, 312/334.44, 334.45, 334.46, 334.47; 384/21
See application file for complete search history.

(56) References Cited

U.S. PATENT DOCUMENTS 5,580,139 A * 12/1996 Grabher ..... 312/333
5,775,787 A * 7/1998 Gasser ..... 312/334.12
6,015,199 A * 1/2000 Netzer et al. ..... 312/334.8
6,497,464 B1 * 12/2002 Cammack et al. ..... 312/333
2004/0222723 A1 * 11/2004 Fitz ..... 312/334.6
2004/0245898 A1 * 12/2004 Amann et al. ..... 312/334.46

FOREIGN PATENT DOCUMENTS

DE 4410340 * 10/1994 ..... 312/334.44

* cited by examiner

*Primary Examiner*—Lanna Mai
*Assistant Examiner*—Hanh V. Tran
(74) *Attorney, Agent, or Firm*—Troxell Law Office, PLLC

(57) ABSTRACT

A structure of a pull adjustable catch for a drawer slide including an adjustable catch outfitted at the front end of the slide track and a turning knob in which the adjustable catch swings when the slide track is being pulled outwardly from the drawer. The adjustable catch has the curved flange and a retaining stud mounted on center of one side. A terminal end of the adjustable catch has a retaining spring to be caught between two stops fo the bumper mounted at the front end of the slide track. The turning knob provides a guide groove for the retaining stud to move along at a curved angle. While the operator turns the turning knob, the guide groove leads the displacement of the retaining stud, limiting the retaining spring moving between two stops of the bumper.

1 Claim, 5 Drawing Sheets

STRUCTURE OF PULL ADJUSTABLE CATCH FOR DRAWER SLIDE

BACKGROUND OF THE INVENTION

1. Field of the Invention

This invention relates to a new technology pertaining to the adjustable catch for the drawer slide.

2. Description of the Related Art

FIG. 1 shows a pulling adjustable catch illustrated in U.S. Pat. No. 6,497,464 in which the adjustable catch 3' is installed at the front end of the slide track 1', a retaining block 4' which is permitted to swing at a certain angle with the catch 3'. There is a dented bumper 5' at the front end of the outer slide panel 2. The inner rim of the bottom of the catch 3' has a catch tail 31' with a section of teeth 32'. The retaining block 4' has a stop pin 41' with one ball end touching the catch tail 31' of the catch 3' and one tooth end 42' meshed to the teeth section 32' of the catch 3' permitting multi-stage angular regulation of swing. When the angle is properly adjusted till the flange 43' falls into the dented bumper 5' of the outer slide panel 2', the pulling force to pull outward of the drawer slide 1' is therefore set up.

It is sure that this design of adjustable catch will achieve the predetermined pulling force for pulling outward the slide track 1', however, the swing angular adjustment of the retaining block 4' within the adjustable catch 3' is troublesome, requiring special tool and strength, inconvenient for general operators.

SUMMARY OF THE INVENTION

The inventor has dedicated great efforts for years to improving the weak points of the prior art and finally come up with this novel pulling adjustable catch for the drawer slide easy for the user to operate.

The major object of this invention is to provide a pulling adjustable catch for the drawer slide which includes an adjustable catch to be outfitted at the front end of the slide track and a turning knob. Operating the turning knob will attain the proper displacement of the adjustable catch which in turn will move into the limited space of the bumper formed at the front end of the outer slide panel of the slide track, control retaining strength of the adjustable catch and determine the pull force required to pull outward of the drawer slide. It is easy and energy saving practice.

BRIEF DESCRIPTIONS OF THE DRAWINGS

DETAILED DESCRIPTION OF THE PREFERRED EMBODIMENT

Figure 1:
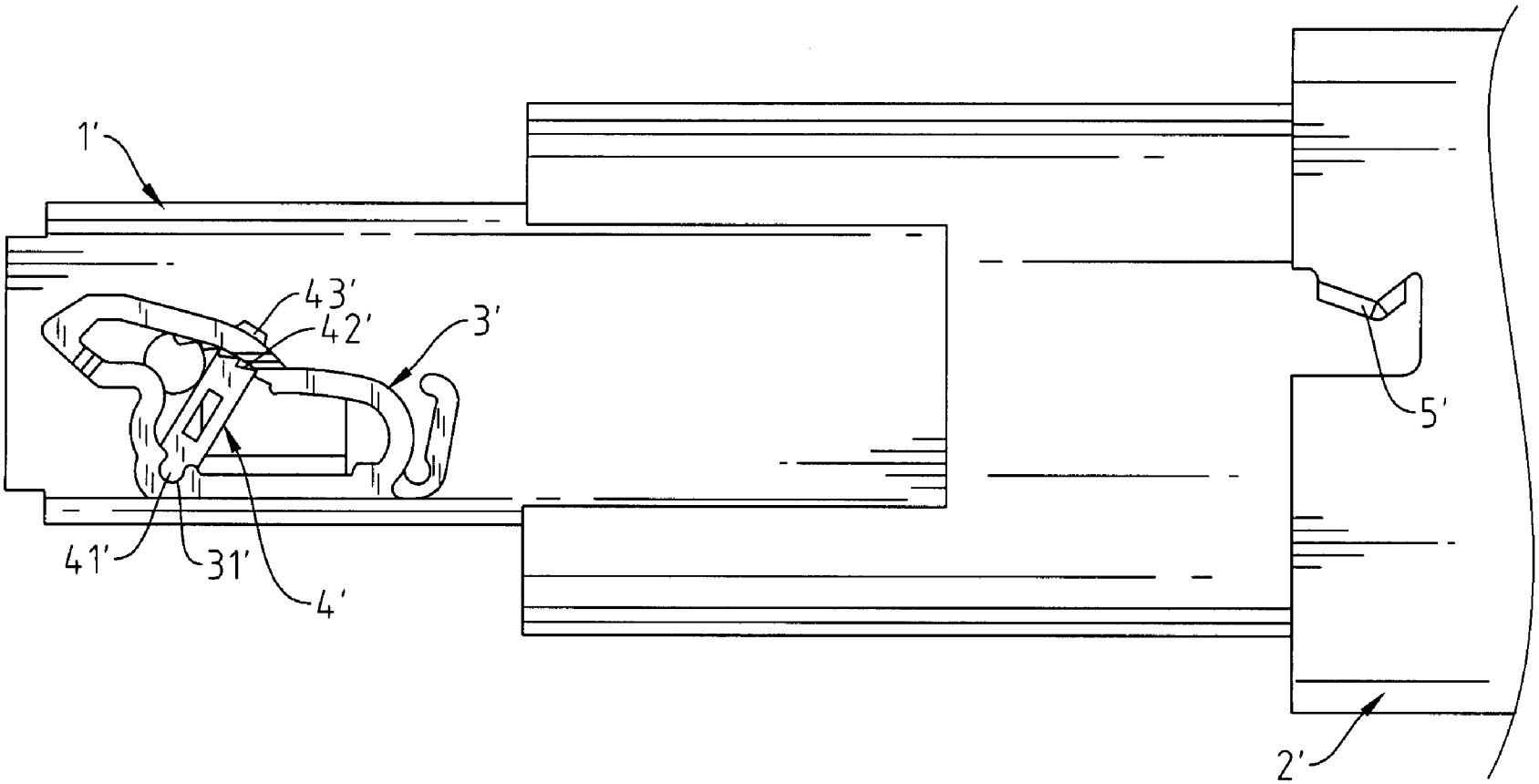
Fig. 1 Prior Art
FIG. 1 shows the schematic diagram of the prior art of adjustable catch for the drawer slide.
Figure 2:
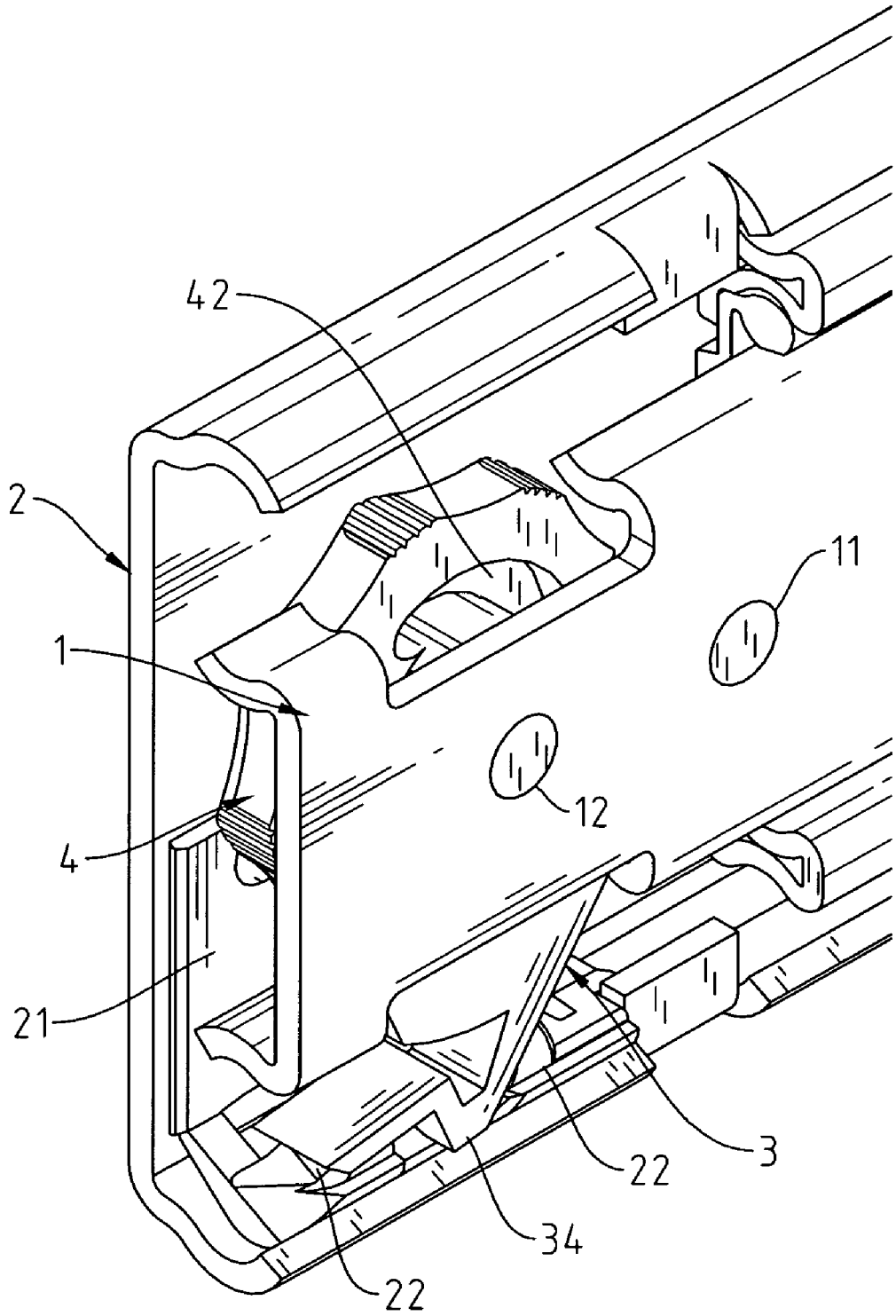
FIG. 2 shows the schematic diagram of the adjustable catch for the drawer slide of this invention.
Figure 3:
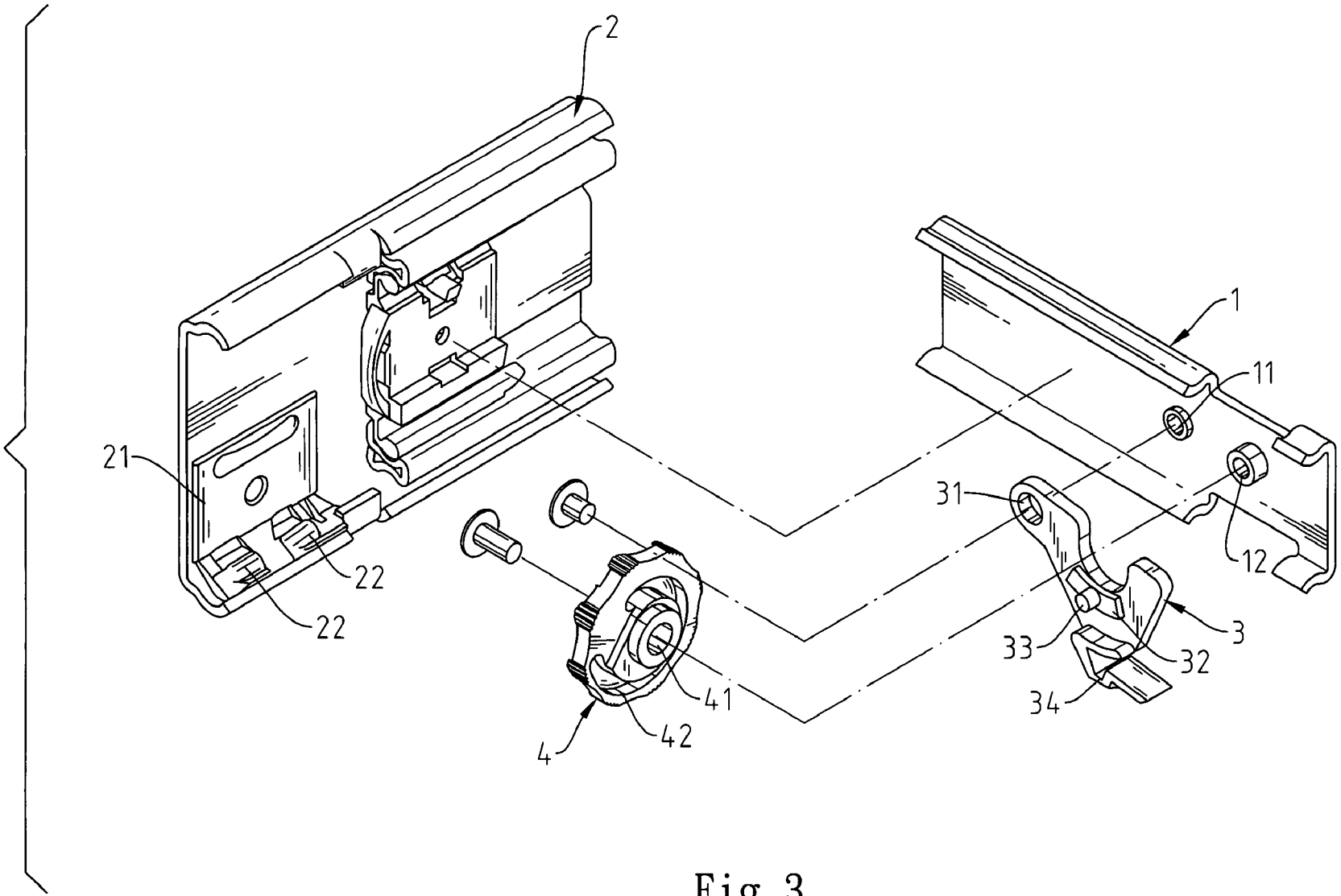
FIG. 3 shows the disassembly of the adjustable catch for the drawer slide of this invention.
Figure 4:
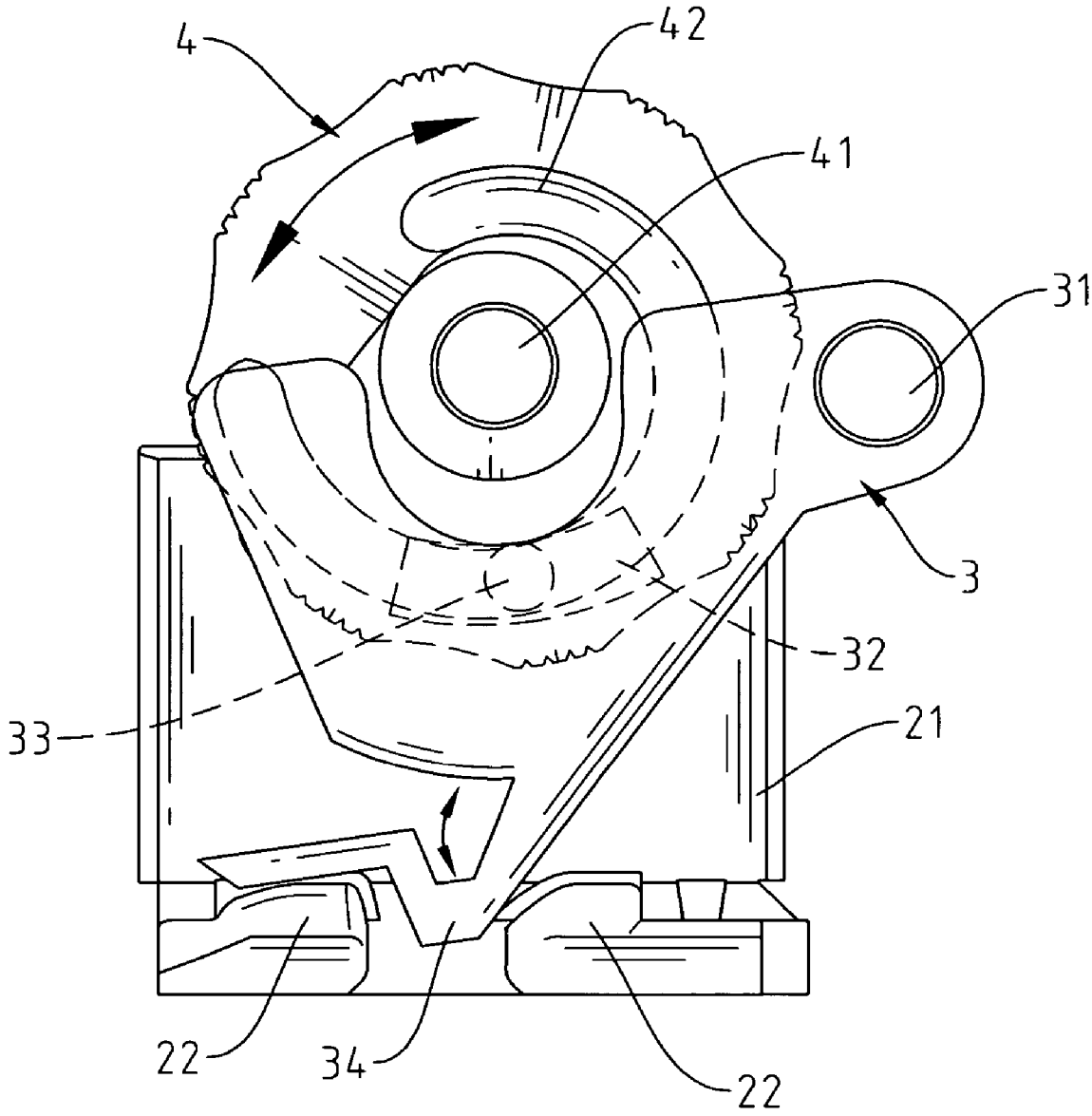
FIG. 4 shows the adjusting practice of adjustable catch for the drawer slide of this invention.

As shown in FIGS. 2 through 4, the structure of the adjustable catch for the drawer slide mainly comprises an adjustable catch 3 outfitted at the front end of slide track 1 and a turning knob 4.

The adjustable catch 3 has a lock hole 31 at one end to be fastened by means of a rivet to the first lock hole 11 of the slide track 1 allowing the adjustable catch 3 to swing along the slide track 1. On the center part of the adjustable catch 3, there provides a curved flange 32 and a retaining stud 33 and a retaining spring 34 at the bottom end of the adjustable catch 3.

The center of turning knob 4 has a lock hole 41 to be fixed to the second lock hole 12 on the slide track 1 with a rivet. The turning knob 4 has a dented curved guide groove 42 with a curvature exactly corresponding to the curved flange 32 of catch 3, and fitting the retaining stud 33 of catch 3 to move within the grove.

There is a bumper 21 mounted on the front end of the outer slide panel 2 The bumper 21 provides two protruded stops 22 disposed with a space to receive the retaining spring 34.

Figure 5:
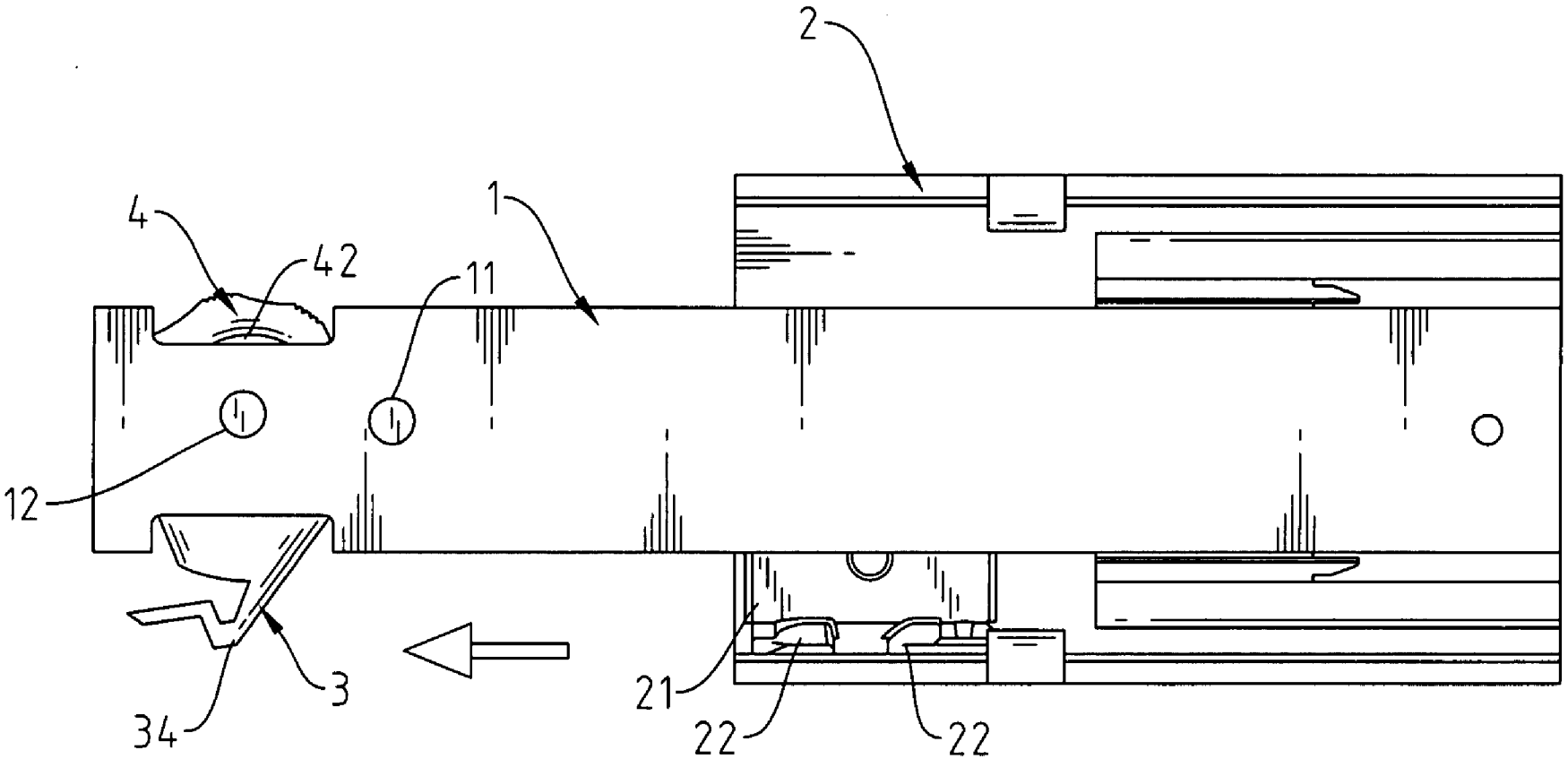
FIG. 5 shows the slide track is being pulled out of the bumper.

It is learned from the above statement that while the slide track 1 of the drawer is the closed position, the space formed between two stops 22 of the bumper 21 on the outer slide panel fits to hold the retaining spring 34 and the slide track 1 becomes still with no forward or backward movement. When it is intended to pull outward the slide track 1, it is necessary to adjust the displacement of the retaining spring 34 by turning the turning knob 4 and the adjustable catch 3. As shown in FIG. 4, while the turning knob 4 is being turned, the guide groove 42 will cause the retaining stud 33 to move and the retaining spring 34 will move upward or downward. The press and release of the retaining spring 34 within the space formed by two stops 22 on the bumper 21 offer a variable control force to determine the pulling force to pull outwardly the drawer slide as shown in the FIG. 5.

The invention claimed is:

1. An adjustable catch structure and drawer slide assembly comprising:

a) an outer slide panel having a bumper having two protruded stops being spaced apart;

b) a slide track slidably inserted into the outer slide panel and having first and second lock holes;

c) an adjustable catch having:

i) a catch lock hole located at a front end thereof and being rotatably connected to the first lock hole;

ii) a curved flange located in a middle section thereof;

iii) a retaining stud protruding from the curved flange; and iv) a retaining spring located at a bottom thereof; and d) a turning knob having:

i) a knob lock hole located in a center thereof and being rotatably connected to the second lock hole; and ii) a dented curved guide groove, the retaining stud is slidably inserted into the dented curved guide groove, wherein, when the turning knob is rotated, the retaining stud moving within the dented curved guide groove and selectively inserting and removing the retaining spring from a space located between the two protruded stops.

* * * * *